US007619185B2

(12) United States Patent
Ichino

(10) Patent No.: US 7,619,185 B2
(45) Date of Patent: Nov. 17, 2009

(54) IMAGE FORMING APPARATUS AND ELECTRIC-POWER CONTROL METHOD

(75) Inventor: Toshiyuki Ichino, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 514 days.

(21) Appl. No.: 10/878,719

(22) Filed: Jun. 29, 2004

(65) Prior Publication Data

US 2007/0193998 A1 Aug. 23, 2007

(30) Foreign Application Priority Data

Jun. 30, 2003 (JP) ..... 2003-188738

(51) Int. Cl.
*H05B 1/02* (2006.01)
*G03G 15/20* (2006.01)

(52) U.S. Cl. ..... 219/494; 219/216; 219/497; 399/69

(58) Field of Classification Search ..... 219/216, 219/469, 490, 494, 497, 507, 509, 510, 517, 219/485, 499, 501, 502, 202; 399/67, 69
See application file for complete search history.

(56) References Cited

U.S. PATENT DOCUMENTS

| | | | | |
|---|---|---|---|---|
| 5,633,668 | A * | 5/1997 | Schwiebert et al. | 347/102 |
| 6,233,398 | B1 * | 5/2001 | Rutherford et al. | 392/503 |
| 6,516,164 | B1 * | 2/2003 | Kawazu | 399/69 |
| 7,076,183 | B2 * | 7/2006 | Kawazu et al. | 399/69 |
| 7,139,500 | B2 * | 11/2006 | Kawazu et al. | 399/69 |
| 7,187,822 | B2 * | 3/2007 | Rizoiu et al. | 385/25 |
| 2003/0155349 | A1 * | 8/2003 | Matsuo et al. | 219/664 |
| 2003/0178410 | A1 * | 9/2003 | Satoh | 219/494 |
| 2004/0146311 | A1 * | 7/2004 | Kawazu et al. | 399/45 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |

(Continued)

OTHER PUBLICATIONS

Official Letter/Search Report issued by the Japanese Patent Office, on Oct. 17, 2008, in Japanese Application No. 2003-188738, with translation.

*Primary Examiner*—Tu B Hoang
*Assistant Examiner*—Stephen J Ralis
(74) *Attorney, Agent, or Firm*—Fitzpatrick, Cella, Harper & Scinto

(57) ABSTRACT

An electric power supply is controlled below a maximum suppliable current value by detecting the applied current of a heater. The image forming apparatus includes a heater which includes heating elements that generate heat when electric power is supplied, a current detector for detecting a current value supplied to the heater, a temperature detector for detecting the temperature of the fixing device, and an electric power controller for supplying electric power to the heater with a current application duty based on the temperature detected by the temperature detector within a range below a maximum current application duty. The maximum current application duty can be reset based on a current application duty to the heater and based on a current value detected by the current detector.

1 Claim, 10 Drawing Sheets

FOREIGN PATENT DOCUMENTS

| | | |
|---|---|---|
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 11-195477 | 7/1999 |
| JP | 2001-318560 | 11/2001 |
| JP | 2003-68426 | 3/2003 |

* cited by examiner

HEATER 2 NOT LIT

D1
D1
D1
D1
γ limit
γ limit
γ limit
γ limit
CONTROL RANGE
CONTROL RANGE
CONTROL RANGE
CONTROL RANGE
ELECTRIC CURRENT NOT DETECTED

IMAGE FORMING APPARATUS AND ELECTRIC-POWER CONTROL METHOD

This application claims priority from Japanese Patent Application No. 2003-188738 filed Jun. 30, 2003, which is incorporated hereinto by reference.

BACKGROUND OF THE INVENTION

1. Field of the Invention

This invention relates to an image forming apparatus and an electric-power control method, and more particularly, to an image forming apparatus that uses a ceramic surface heating system as a heating means and to an electric-power control method.

2. Description of the Related Art

Conventionally, an image forming apparatus that uses an electrophotographic process is known. A thermal fixing device in the image forming apparatus fixes an unfixed image (toner image) formed on transfer paper by an image forming means, such as an electrophotographic process, onto the transfer paper. A device having a roller heating system that uses a halogen heater as a heat source or a device having a film heating system that uses a ceramic surface heater as a heat source is known as the thermal fixing device. For example, see Japanese Patent Application Laid-open Nos. 63-313182 (1988), 2-157878 (1990), 4-044075 (1992), 4-044076(1992), 4-044077(1992), 4-40078(1992), 4-044079 (1992), 4-044080(1992), 4-044081 (1992), 4-044082 (1992), 4-044083(1992), 4-204980(1992), 4-204981(1992), 4-204982 (1992), 4-204983 (1992), and 4-204984 (1992).

A heater is connected to an AC power source through a switching element such as a triac. Electric power is supplied from the AC power source to the heater. A thermal fixing device that uses the heater as a heat source includes a temperature detecting element, e.g., a thermistor temperature-sensitive element. The temperature detecting element detects the temperature of the thermal fixing device and transmits detected temperature information to a sequence controller. The sequence controller performs temperature control so that the switching element is turned on or of f based on the detected temperature information, and thereby a power supply to the heater, which is the heat source of the thermal fixing device, is turned on or off so that the thermal fixing device can reach a desired temperature. A ceramic surface heater is turned on or off by controlling the phase or wavenumber of the AC power source.

When the temperature of the thermal fixing device is controllably adjusted, the sequence controller calculates a difference in the electric power supplied to the heater by a comparison between the temperature detected by the thermal detector and a predetermined target temperature. The sequence controller then determines a phase angle or a wavenumber that corresponds to a resultant power difference, and controllably turns on or of f the switching element based on its phase condition or wavenumber condition.

The AC power source that supplies electric power to heaters has a wide-ranging power-supply voltage of, for example, from 85V to 140V or from 187V to 264V. Therefore, when all heaters are supplied with electric power, about 2.7 times as large a power difference arises in a case in which the power-supply voltage is within a range of 85V to 140V, and about twice as large a power difference arises in a case in which the power-supply voltage is within a range of 187V to 264V. Additionally, the sequence controller controls an electric current supplied to the heaters so as to reach a predetermined temperature. Therefore, if thick paper is fed to the thermal fixing device, quantitatively greater electric power, i.e., greater electric current is supplied than in regular paper. Since the sequence controller controls the thermal fixing device so as to keep the thermal fixing device at the predetermined temperature, there is the possibility that an excessive quantity of electric power will be supplied depending on paper types. Therefore, there is a need to control an applied current of the heater so as to be kept below a maximum suppliable current value while always detecting the current, in order not to supply an excessive electric current to the heater that is a constituent element of the thermal fixing device.

However, regardless of electric power of the electric current to the heater, the maximum suppliable current value always is calculated while detecting the current, consequently load of the sequence controller increases and thermal efficiency decreases.

Additionally, when the thermal fixing device includes two or more heaters, there is a case in which some of the heaters are not supplied with an electric current while sheets of paper are being fed, depending on the paper type of transfer paper. In this case, an applied current is smaller than in a case in which all heaters are supplied with an electric current. Therefore, a maximum suppliable current value determined from this current value is set to be greater than in that case in which all heaters are supplied with an electric current. Therefore, a conventional problem resides in the fact that an excessive electric current is supplied when all heaters are supplied with an electric current after having determined the maximum value to be greater.

SUMMARY OF THE INVENTION

It is an object of the present invention to provide an image forming apparatus and an electric-power control method that are capable of controlling an electric power supply below a maximum suppliable current value by detecting an applied current of a heater without supplying an excessive quantity of electric current to the heater that is a constituent element of a fixing device only when a difference in electric power supplied to the heater exceeds a predetermined value.

An image forming apparatus according to an embodiment of the present invention has a heating means which is included in a fixing device and which includes a heating element that generates heat when electric power is supplied, a current detecting means for detecting a current value (I1) supplied to the heating means, a setting means for setting a maximum current application duty ($D_{limit}$) of electric power to the heating means, a temperature detecting means for detecting the temperature of the fixing device, and an electric power control means for supplying electric power to the heating means at a current application duty based on temperature detected by the temperature detecting means within a range below the maximum current application duty ($D_{limit}$) set by the setting means. The setting means of the image forming apparatus newly sets a maximum current application duty ($D_{limit}(\beta)$) based on the current application duty to the heating means and based on a current value (I2) detected by the current detecting means.

The setting means can also reset the maximum current application duty ($D_{limit}(\beta)$) based on the current application duty to the heating means and based on the current value (I2) detected by the current detecting means if the current application duty to the heating means exceeds a predetermined fixed duty (D1).

In a case in which the heating means includes a plurality of heating elements, the setting means can also newly set the maximum current application duty ($D_{limit}(\beta)$) based on the current application duty to the heating means and based on the current value (I2) detected by the current detecting means if electric power is supplied to all of the plurality of heating elements and if the current application duty to the heating means exceeds the predetermined fixed duty (D1).

As described above, according to the present invention, an electric power supply can be controlled below a maximum suppliable current value by detecting an applied current of the heater without supplying an excessive electric current to the heater that is a constituent element of the fixing device.

Additionally, according to the present invention, only when a predetermined value is exceeded, an electric power supply can be controlled below a maximum suppliable current value by detecting an applied current of the heater without increasing the burden of the electric power control means.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be hereinafter described in detail with reference to the attached drawings.

Figure 1:
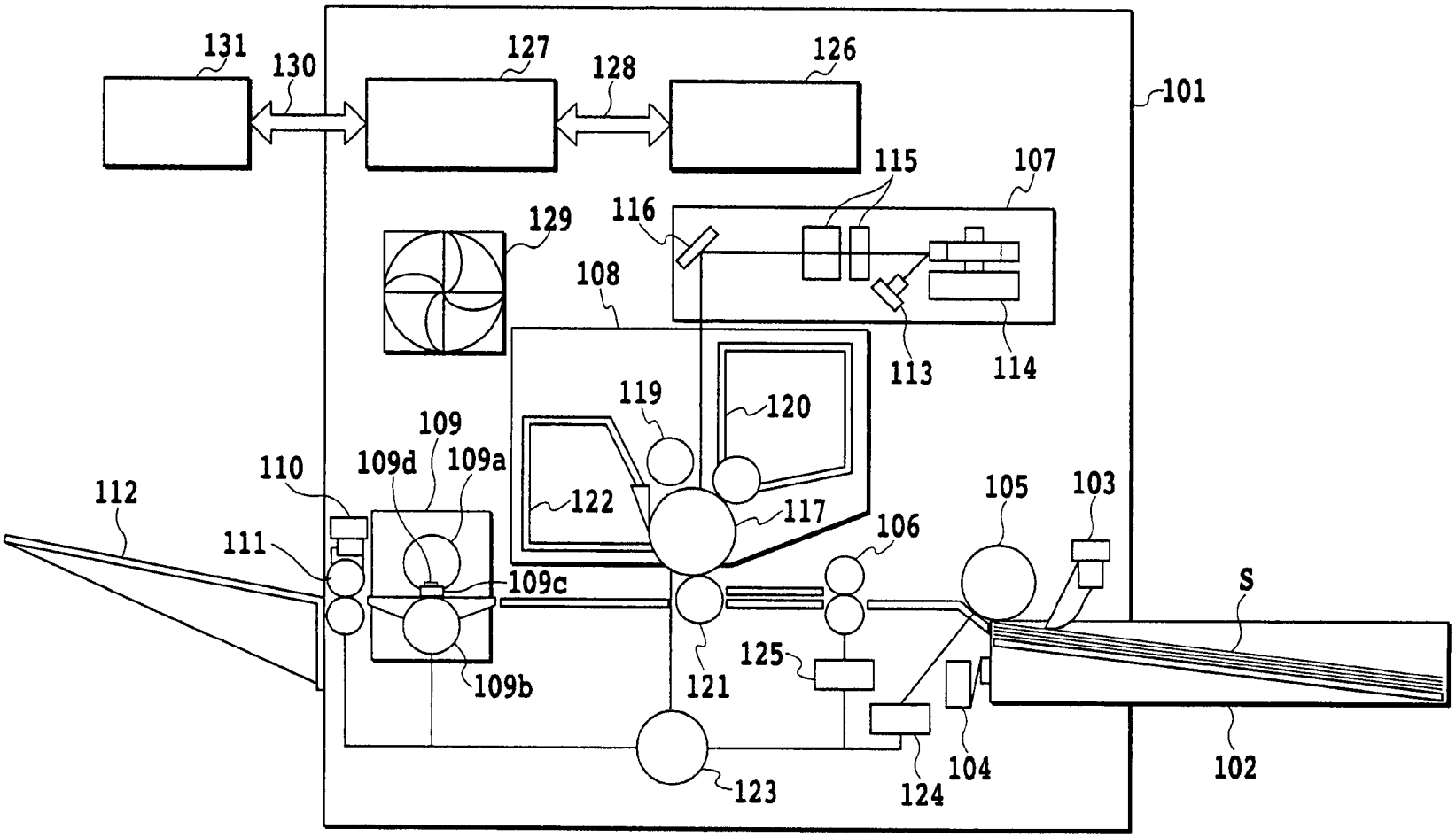
FIG. 1 is a schematic view showing an image forming apparatus according to an embodiment of the present invention.

FIG. 1 shows an image forming apparatus according to an embodiment of the present invention. The image forming apparatus of FIG. 1 is a laser printer. A laser printer body (hereinafter, referred to simply as "main body") 101 includes a cassette 102 that contains recording paper S, a cassette presence sensor 103 that detects the presence or absence of the recording paper S of the cassette 102, a cassette size sensor (which is made up of a plurality of microswitches) 104 that detects the size of the recording paper S of the cassette 102, and a paper feed roller 105 that feeds out the recording paper S from the cassette 102. A resist roller pair 106 that synchronously conveys the recording paper S is provided on the downstream side of the paper feed roller 105.

An image forming portion 108 that forms a toner image on the recording paper S based on a laser beam emitted from a laser scanner portion 107 is disposed on the downstream side of the resist roller pair 106. A fixing device 109 that thermally fixes the toner image formed on the recording paper S is disposed on the downstream side of the image forming portion 108. An ejection paper sensor 110 that detects a conveying state of a paper ejecting portion, a paper ejecting roller 111 that ejects the recording paper S, and a paper loading tray 112 that loads together sheets of recording paper S on which records have been made are disposed on the downstream side of the fixing device 109. The conveying standard of the recording paper S is set to be situated at the center with respect to the length in a direction perpendicular to a conveying direction of the image forming apparatus of the recording paper S, i.e., with respect to the width of the recording paper S.

The laser scanner portion 107 is made up of a laser unit 113 that emits a modulated laser beam based on an image signal (image signal VDO) sent from an external device 131 described later, a polygon motor 114 used to perform scanning with a laser beam emitted from the laser unit 113 on a photoconductor drum 117 described later, an image formation lens 115, and a return mirror 116.

The image forming portion 108 is made up of the photoconductor drum 117, a primary electrification roller 119, a developing device 120, a transfer electrification roller 121, and a cleaner 122, which are needed for a known electrophotographic process. The fixing device 109 is made up of a fixing film 109*a*, a pressure roller 109*b*, a ceramic heater 109*c* disposed in the fixing film, and a thermistor 109*d* that detects the surface temperature of the ceramic heater.

A main motor 123 gives a driving force to the paper feed roller 105 through a paper feed roller clutch 124, and gives a driving force to the resist roller pair 106 through a resist roller clutch 125. The main motor 123 additionally gives a driving force to each unit of the image forming portion 108 including the photoconductor drum 117, to the fixing device 109, and to the paper ejecting roller 111. An engine controller 126 controls an electrophotographic process carried out by the laser scanner portion 107, the image forming portion 108, and the fixing device 109, and controls the conveying of the recording paper in the main body 101.

A video controller 127 is connected to the external device 131, such as a personal computer, through a general-purpose interface (Centronics, RS232C, etc) 130. The video controller 127 develops image information sent from the general-purpose interface 130 into bit data, and sends the bit data to the engine controller 126 as VDO signals.

Figure 2:
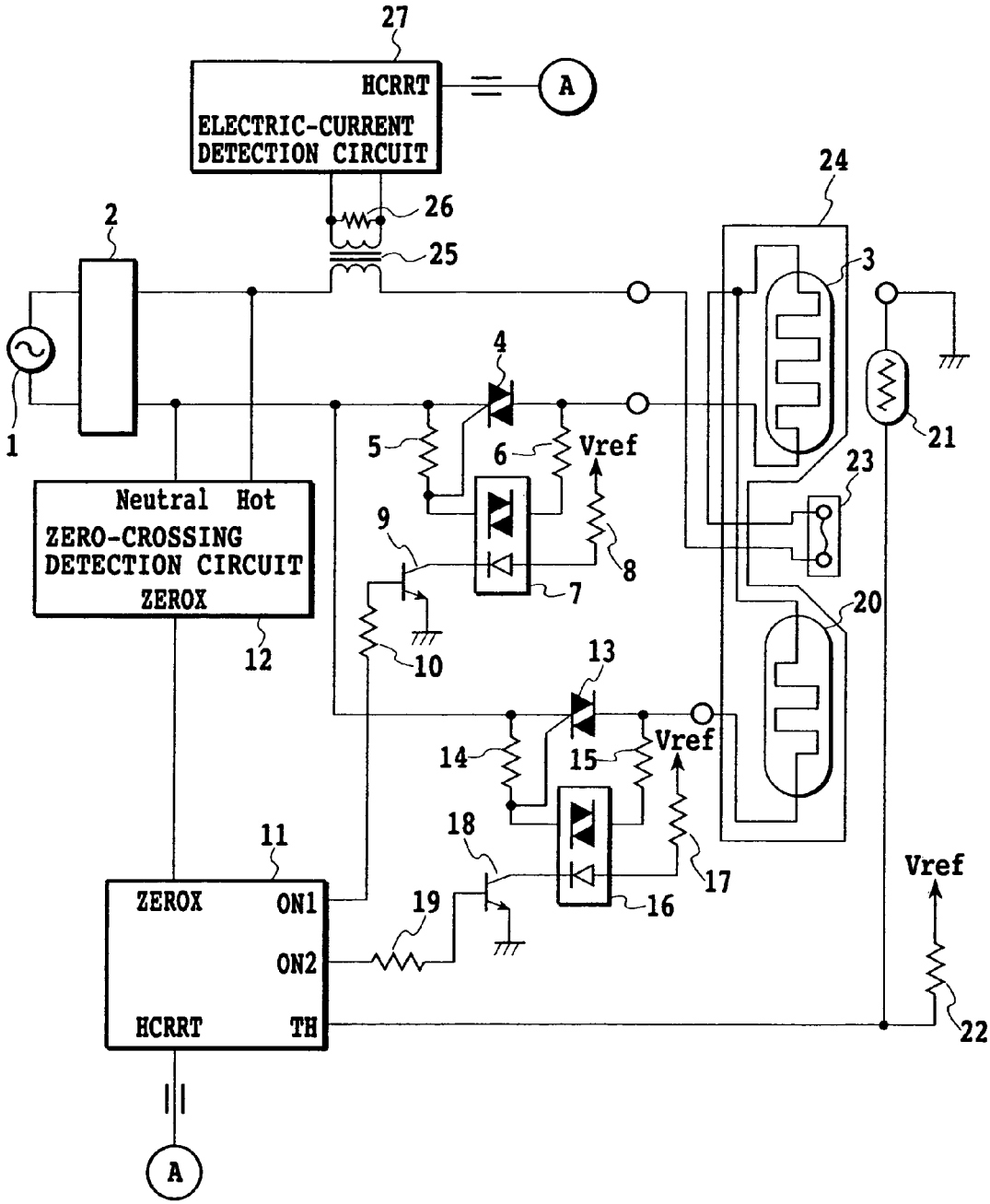
FIG. 2 is a block diagram showing a control circuit of a ceramic heater according to an embodiment of the present invention.

FIG. 2 shows a control circuit of a ceramic heater according to an embodiment of the present invention. The image forming apparatus is connected to an AC power source 1. The AC power source 1 is connected to heating elements 3 and 20 of the ceramic heater 24 (corresponding to 109*c* of FIG. 1), which are heating means of the fixing device 109, through an AC filter 2. The heating elements 3 and 20 are heated by supplying alternating current. The control circuit controls the phase angle or wavenumber of this alternating current, and controls electric power supplied to the ceramic heater 24.

Electric power is controllably supplied to the heating element 3 by applying or cutting an electric current to a triac 4. Resistors 5 and 6 are bias resistors for the triac 4. A photo-triac coupler 7 is a device for securing a creeping distance between primary and secondary points. The triac 4 is turned on by applying an electric current to a light emitting diode of the photo-triac coupler 7. A resistor 8 is used to limit the electric current of the photo-triac coupler 7, and the photo-triac coupler 7 is turned on or off by a transistor 9. The transistor 9 operates in accordance with an ON1 signal sent through the resistor 10 from an engine controller 11 (corresponding to 126 of FIG. 1).

Electric power is controllably supplied to the heating element 20 by applying or cutting an electric current to a triac 13. Resistors 14 and 15 are bias resistors for the triac 13. A photo-triac coupler 16 is a device for securing a creeping distance between primary and secondary points. The triac 13 is turned on by applying an electric current to a light emitting diode of the photo-triac coupler 16. A resistor 17 is used to limit the electric current of the photo-triac coupler 16, and the photo-triac coupler 16 is turned on or off by a transistor 18. The transistor 18 operates in accordance with an ON2 signal sent through the resistor 19 from the engine controller 11.

The AC power source 1 is connected to the zero-crossing detection circuit 12 through the AC filter 2. The zero-crossing detection circuit 12 transmits a pulse signal, which indicates that a commercial power-supply voltage is lower than a threshold, to the engine controller 11. The pulse signal transmitted to the engine controller 11 will be hereinafter referred to as "ZEROX signal." The engine controller 11 detects the edge of a pulse of the ZEROX signal, and turns on or off the triacs 4 and 13 under phase control or wavenumber control. A heater current applied to the heating elements 3 and 20 is controlled by the triacs 4 and 13, respectively.

The heater current is subjected to voltage conversion by a current transformer 25, and is input to an electric-current detection circuit 27 through a bleeder resistor 26. The electric-current detection circuit 27 converts the waveform of the heater current, which has undergone the voltage conversion, into an average value or an effective value, and inputs its value to the engine controller 11 in the form of an HCRRT signal.

The thermal detector (corresponding to 109*d* of FIG. 1) 21 is, for example, a thermistor temperature-sensitive element, and detects the temperature of the ceramic heater 24 that contains the heating elements 3 and 20. The thermal detector 21 is disposed on the ceramic heater 24 with an insulating material interposed therebetween, which has a withstand voltage so as to be able to secure an insulation distance against the heating elements 3 and 20. The temperature detected by the thermal detector 21 is detected as partial power of the resistor 22 and the thermal detector 21, and is input to the engine controller 11 in the form of a TH signal.

The engine controller 11 detects the temperature of the ceramic heater 24 in accordance with the TH signal. A difference in electric power to be supplied to the heating elements 3 and 20 that are constituent elements of the ceramic heater 24 is calculated by a comparison between the predetermined temperature of the ceramic heater 24 set in the engine controller 11 and the detected temperature. The engine controller 11 converts the calculated power difference into a phase angle (phase control) or a wavenumber (wavenumber control). According to the converted control value, an ON1 signal is sent to the transistor 9, or an ON2 signal is sent to the transistor 18. When a power difference is calculated, the upper limit of the power difference is calculated based on an HCRRT signal sent from the electric-current detection circuit 27, and an electric current is applied so as not to exceed this upper limit. For example, the engine controller 11 has a control table shown in Table 1, and performs the phase control in accordance with this control table.

TABLE 1

Control table that the engine controller 11 has

| Duty D (%) | Phase angle α (°) |
|---|---|
| 100 | 0 |
| 97.5 | 28.56 |
| . | . |
| . | . |
| . | . |
| 75 | 66.17 |
| . | . |
| . | . |
| . | . |
| 50 | 90 |
| . | . |
| . | . |
| . | . |
| 25 | 113.83 |
| . | . |
| . | . |
| . | . |
| 2.5 | 151.44 |
| 0 | 180 |

On the ceramic heater 24, an overtemperature preventing means 23 is additionally disposed. The overtemperature preventing means 23 prevents an overtemperature condition when the control circuit breaks down so as to bring the heating elements 3 and 20 into a thermal runaway state. The overtemperature preventing means 23 is, for example, A thermal fuse or a thermoswitch. When the heating elements 3 and 20 reach a thermal runaway state, the overtemperature preventing means 23 exceeds a predetermined temperature and is opened, so that an electric current stops being supplied to the heating elements 3 and 20.

Figure 3:
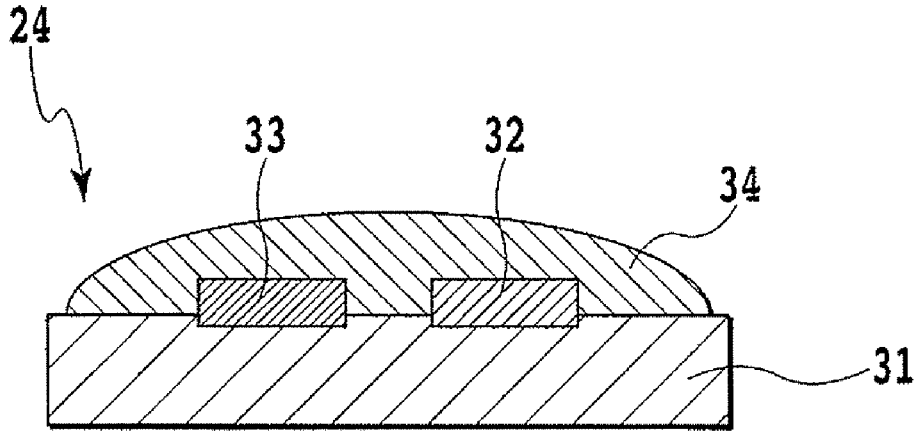
FIG. 3 is a sectional view showing a structure of the ceramic heater provided in a fixing device.
Figure 4:
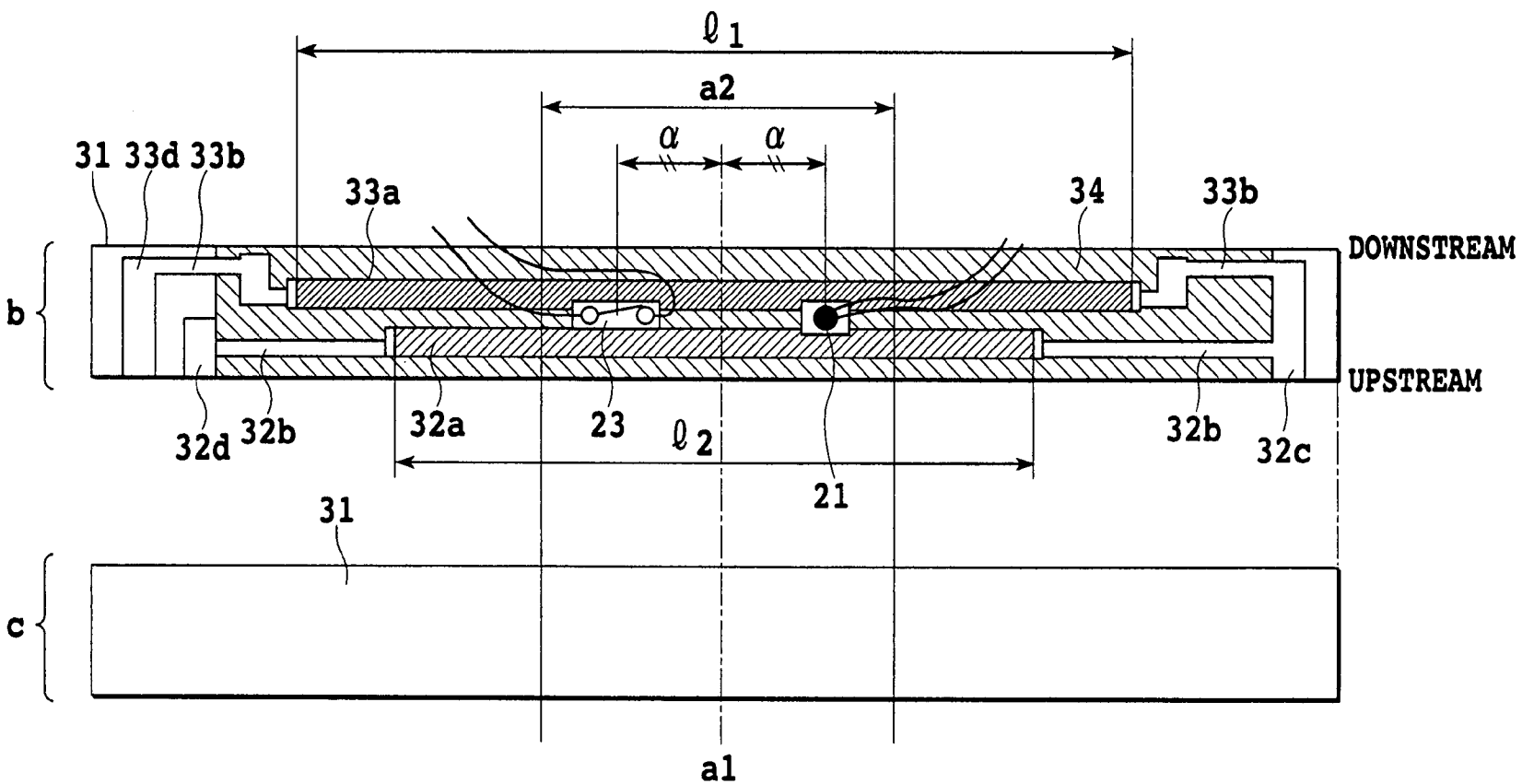
FIG. 4 is a plan view showing the structure of the ceramic heater provided in the fixing device.

FIG. 3 is a sectional view showing a structure of the ceramic heater provided in the fixing device, and FIG. 4 is a plan view thereof. The ceramic surface heater 24 is made up of an insulating substrate 31 made of ceramic, such as SiC, AlN, or $Al_2O_3$, heating elements 32 and 33 (corresponding to 3 and 20 of FIG. 2) formed by, for example, paste printing onto the insulating substrate 31, and a protective layer 34 that is made of glass or the like and that protects the two heating elements. The thermal detector 21 that detects the temperature of the ceramic surface heater 24 and the overtemperature preventing means 23 are disposed on the protective layer 34. The thermal detector 21 and the overtemperature preventing means 23 are placed at a position α that is symmetrical with respect to the conveying standard of the recording paper, i.e., with respect to the center a1 in the lengthwise direction of heating portions 32*a* and 33*a*, and are positioned within a minimum paper width a2 with which the recording paper can be fed. Herein, in order to improve slidability, a glass layer may be formed on a surface "c" facing the surface "b" of the insulating substrate 31 on which the heating elements 32 and 33 are printed.

The heating element 32 is made up of a heating portion 32*a* that generates heat when electric power is supplied, electrode portions 32*c* and 32*d* to which electric power is supplied through a connector, and a conductive portion 32*b* by which the heating portion 32*a* and the electrode portions 32*c* and 32*d* are connected together. The heating element 33 is made up of the heating portion 33*a* that generates heat when electric power is supplied, the electrode portions 32*c* and 33*d* to which electric power is supplied through the connector, and a conductive portion 33*b* by which the heating portion 33*a* and the electrode portions 32*c* and 33*d* are connected together.

The electrode portion 32*c* is connected to the two heating elements 32 and 33, and is a shared electrode between the heating elements 32 and 33.

The electrode portions 32*c* and 32*d* that are a shared electrode and a hot-side terminal of the AC power source 1 are connected together through the overtemperature preventing means 23. The electrode portion 32*d* is connected to a neutral terminal of the AC power source 1 through the triac 4 that controls the heating element 32. The electrode portion 33*d* is connected to the neutral terminal of the AC power source 1 through the triac 13 that controls the heating element 33.

Figure 5:
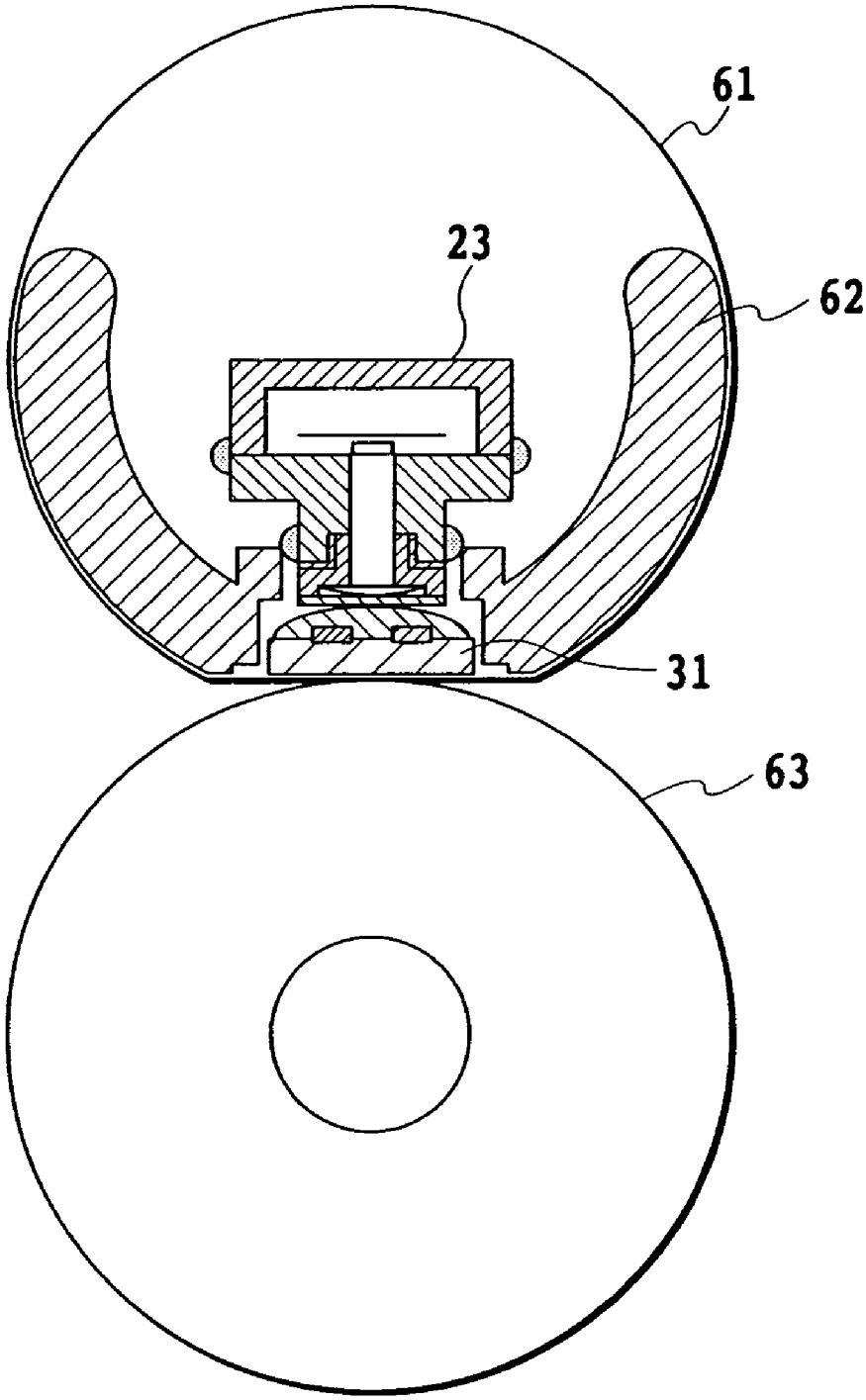
FIG. 5 is a sectional view showing the fixing device according to an embodiment of the present invention.

FIG. 5 is a sectional view of the fixing device. The ceramic heater (corresponding to 109*c* of FIG. 1) 24 is supported by a film guide 62. A cylindrical fixing film (corresponding to 109*a* of FIG. 1) 61 made of a heat-resistant material is fitted onto the film guide 62 that supports the ceramic heater 24 on its undersurface side. The fixing film 61 is interposed between the ceramic heater 24 at the undersurface of the film guide 62 and an elastic pressure roller (corresponding to 109*b* of FIG. 1) 63 serving as a pressure member, and is brought into contact therewith a predetermined pressing force against the elasticity of the elastic pressure roller 63. The pressure contact part forms a fixing nip portion with a predetermined width as a heating portion.

Figure 6:
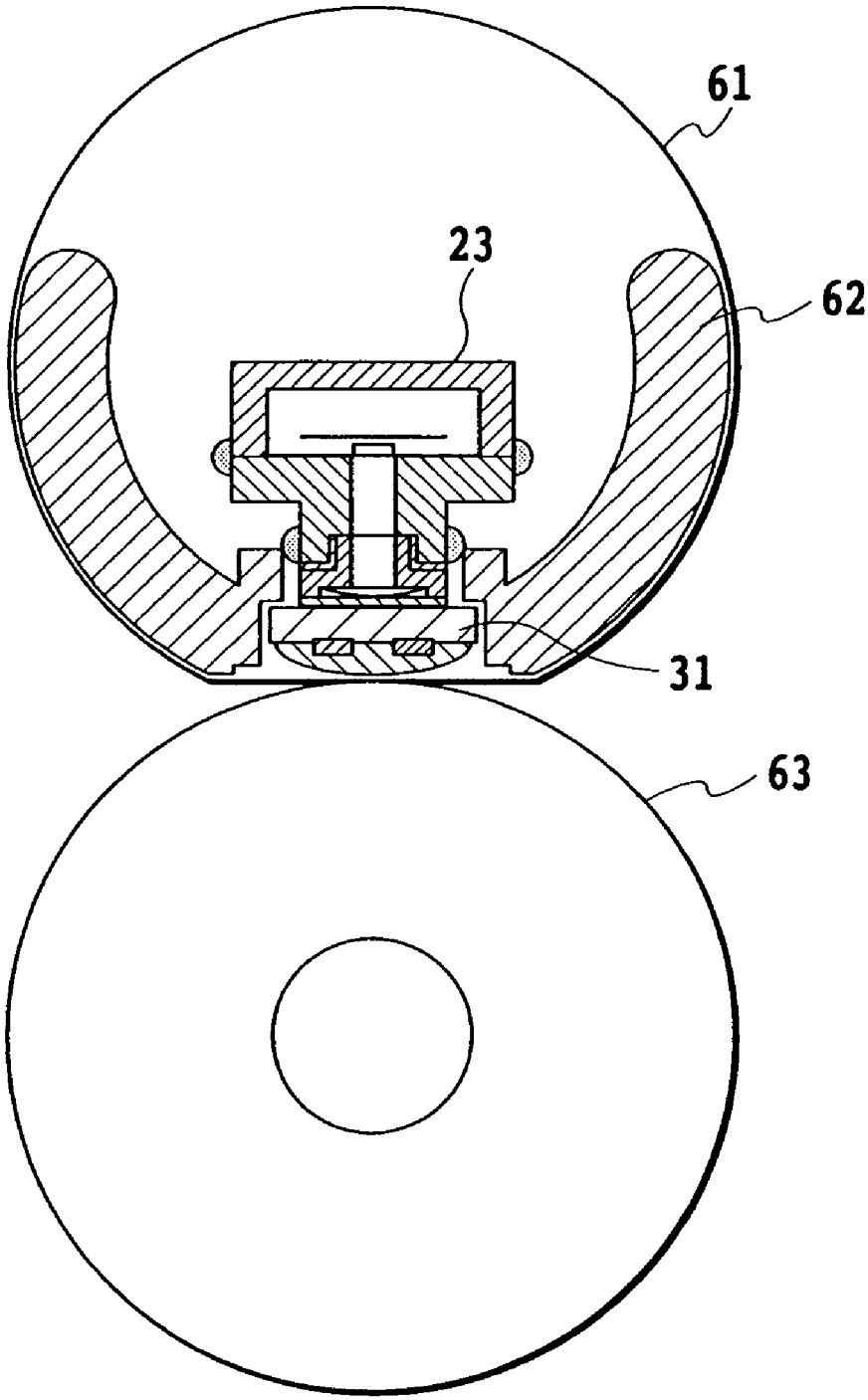
FIG. 6 is a sectional view showing the fixing device according to another embodiment of the present invention.

The overtemperature preventing means (e.g., thermostat) 23 is in contact with the surface of the insulating substrate 31 of the ceramic heater 24 or with the surface of the protective layer 34. The thermostat 23 is positionally corrected by the film guide 62, so that a thermosensitive surface of the thermostat 23 comes into contact with the surface of the ceramic heater 24. Likewise, the thermal detector 21 is in contact with the surface of the ceramic heater 24, not shown. Herein, it is permissible to dispose the heating elements 32 and 33 on the opposite side of the fixing nip portion in the ceramic heater 24, as shown in FIG. 6. Additionally, in order to raise the slidability of the film 61, it is permissible to apply grease, which can create a slippery state, onto an interface between the film 61 and the ceramic heater 24.

Figure 7:
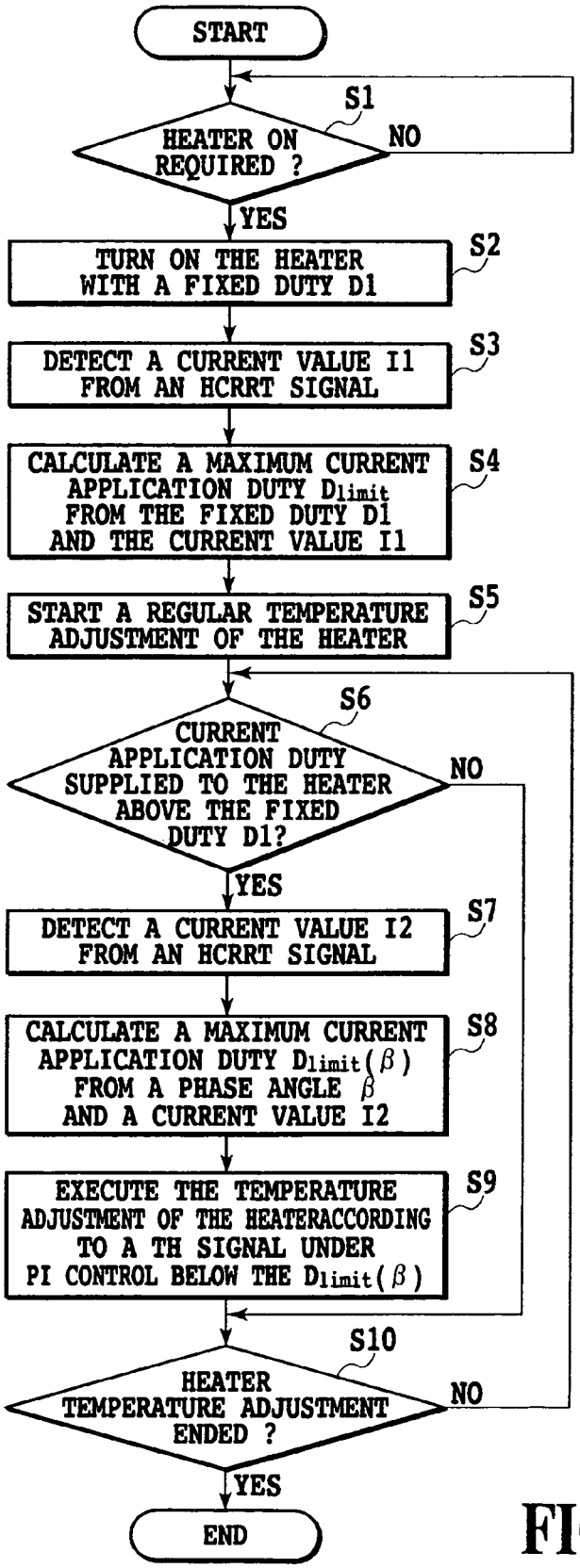
FIG. 7 is a flowchart showing a control sequence of the fixing device according to a first embodiment of the present invention.

FIG. 7 shows a control sequence of the fixing device according to a first embodiment of the present invention. FIGS. 8A-8E show operation waveforms of a heater current and ON1 and ON2 signals. When the engine controller 11 is required to start supplying electric power to the ceramic heater 24 (S1), an electric current is applied to both of the heating elements 3 and 20 with the same, predetermined fixed duty D1 (S2). The term "duty" denotes the percentage of electric power obtained when a heater current is supplied at an arbitrary phase angle on the supposition that electric power obtained when the full-wave supply of a heater current is carried out is regarded as "100." The engine controller 11 sends ON1 and ON2 signals, with a ZEROX signal (see FIG. 8C) as a trigger, at a phase angle $\alpha$1 corresponding to the fixed duty D1 (see FIG. 8B). The heater is supplied with the heater current at the phase angle $\alpha$1 (see FIG. 8A).

While the heater current is being applied at the fixed duty D1, a current value I1 of the heater current is detected in accordance with an HCRRT signal sent from the electric-current detection circuit 27 (S3). The fixed duty D1 is set not to exceed an allowable current in consideration of a presupposed input voltage range and a resistance value of the heating element. In other words, the fixed duty D1 is set on the assumption that the input voltage has a maximum amount, and the resistance value has a minimum amount. A maximum current application duty $D_{limit}$ that is an applicable upper limit is calculated from a detected current value I1, the fixed duty D1, and a predetermined applicable current value $I_{limit}$ in the engine controller 11 (S4). If the current value detected by the electric-current detection circuit 27 is an effective value, the duty $D_{limit}$ is calculated according to the following equation.

$$D_{limit}=(I_{limit}/I1)^2\times D1$$

The current value $I_{limit}$ sets an allowable current value obtained by subtracting an electric current supplied to elements excluding the ceramic heater 24 with respect to a rated current of the AC power source 1 to be connected.

The duty $D_{limit}$ at the start of the heater is calculated, and then a regular temperature adjustment is started (S5). The engine controller 11 controls electric power supplied to the heating elements based on temperature detected by a TH signal according to known PI control so as to reach a predetermined temperature. The duty of an electric current to be applied is determined from a difference between the desired predetermined temperature and the temperature detected by the TH signal.

Thereafter, the engine controller 11 always detects whether or not an electric current is applied in a state in which the phase angle of electric power supplied to the fixing device is above the fixed duty D1 (i.e., below the phase angle $\alpha$1) (S6). If above the fixed duty D1, a current value I2 is always detected by a phase angle $\beta$ (see FIG. 8E) supplied to the fixing device and the HCRRT signal sent from the electric-current detection circuit 27 (S7). The engine controller 11 determines a maximum current application duty $D_{limit}$ that is an applicable upper limit (which corresponds to a phase angle $\beta_{limit}$ and which is represented as $D_{limit}(\beta)$ herein) from the detected current value I2, the phase angle $\beta$, and the predetermined applicable current value $I_{limit}$ (S8). Therefore, the duty $D_{limit}$ is always changing. However, if an electric current is not applied in a state in which the phase angle of electric power supplied to the fixing device is above the fixed duty D1, the upper limit power duty holds the last determined duty $D_{limit}$ (which is the fixed duty D1 that corresponds to the phase angle $\alpha$1 herein) without detecting the current value I2.

Figures 8A, 8B, 8C, 8D, 8E:
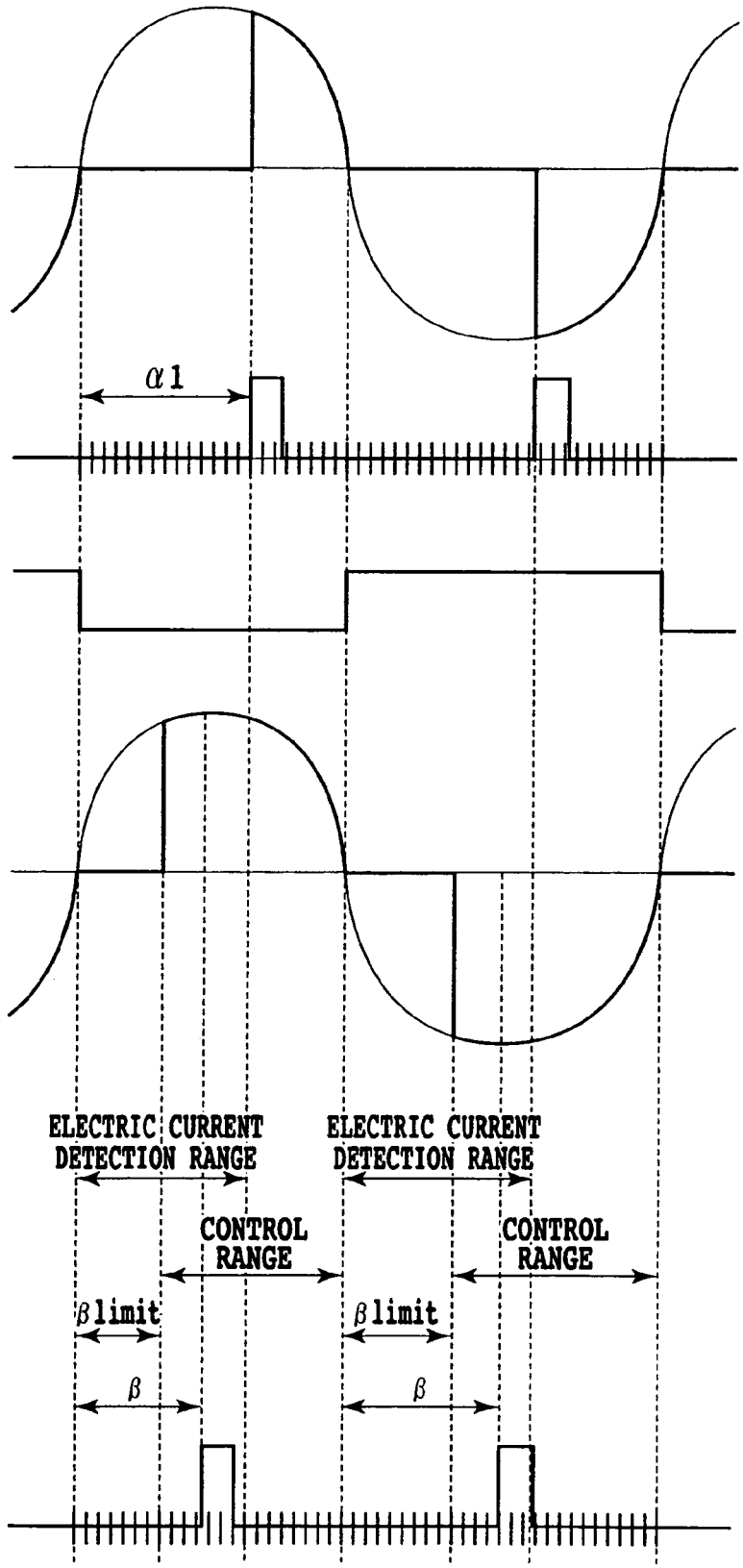
FIGS. 8A-8E are charts showing operation waveforms of the control sequence according to the first embodiment.

If the calculated maximum current application duty $D_{limit}$ ($\beta$) that is an applicable upper limit is above the fixed duty D1, electric power is supplied, with the upper limit value as $D_{limit}$ ($\beta$). That is, a PI temperature adjustment is performed in a state of being below the applicable upper limit maximum current application duty $D_{limit}(\beta)$ (i.e., above the phase angle $\beta_{limit}$) (S9). The waveform of the ON1 and ON2 signals at this time is shown in FIG. 8E, and the waveform of the heater current is shown in FIG. 8D. Control is carried out below the calculated maximum current application duty $D_{limit}(\beta)$ until receiving a command to end the heater temperature adjustment (S10).

As described above, in the first embodiment, the detection is always performed for whether or not an electric current is applied in a state of exceeding the fixed duty D1 that is set not to exceed an allowable current, in consideration of the input voltage range in which the phase angle of electric power supplied to the fixing device is presupposed and the resistance value of the heating element. If above the fixed duty D1, the upper limit value of supplied power is calculated, and the electric power is controlled below the calculated upper limit value. Accordingly, an electric current exceeding the allowable current value can be prevented from being supplied. Only when the predetermined duty is exceeded, i.e., only when a difference in electric power supplied to the heater exceeds the predetermined value, the burden of the engine controller can be reduced by detecting the electric current.

Figure 9:
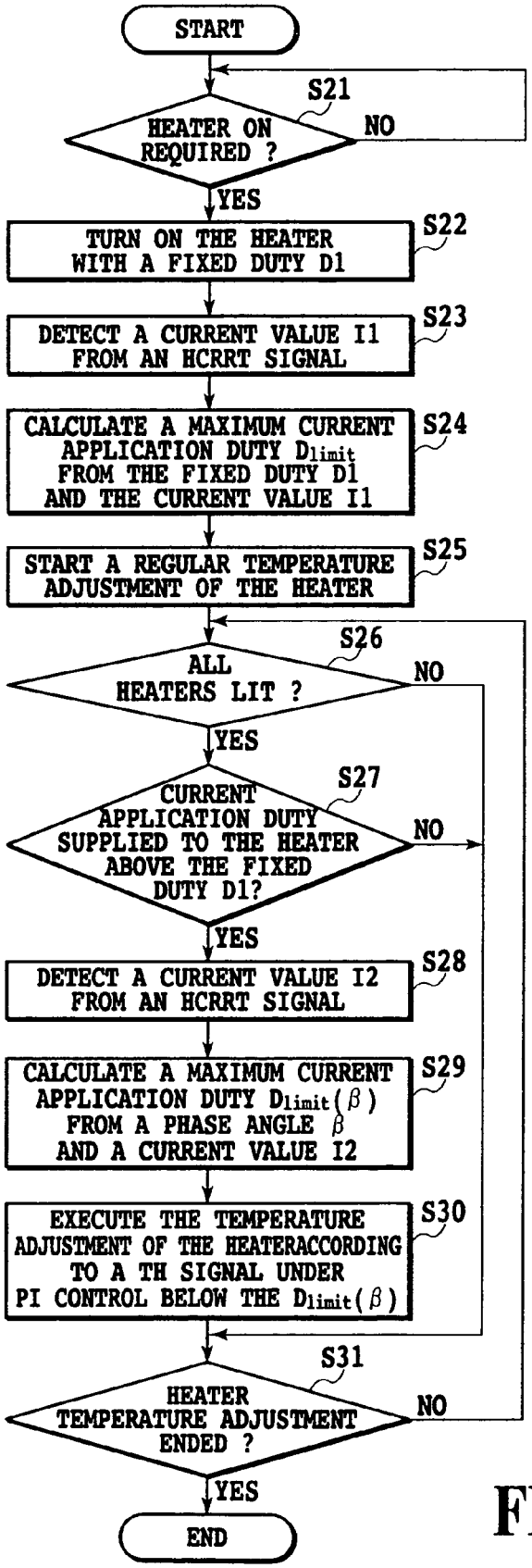
FIG. 9 is a flowchart showing a control sequence of the fixing device according to a second embodiment of the present invention.

FIG. 9 shows a control sequence of the fixing device according to a second embodiment of the present invention. FIGS. 10A-11E show operation waveforms of a heater current and ON1 and ON2 signals. When the engine controller 11 is required to start supplying electric power to the ceramic heater 24 (S21), an electric current is applied to both of the heating elements 3 and 20 with the same, predetermined fixed duty D1 (S22). The engine controller 11 sends ON1 and ON2 signals, with a ZEROX signal (see FIG. 10C) as a trigger, at a phase angle $\alpha 1$ corresponding to the fixed duty D1. The heater is supplied with the heater current at the phase angle $\alpha 1$.

While the heater current is being applied at the fixed duty D1, a current value I1 of the heater current is detected in accordance with an HCRRT signal sent from the electric-current detection circuit 27 (S23). The fixed duty D1 is set not to exceed an allowable current in consideration of a presupposed input voltage range and a resistance value of the heating element. In other words, the fixed duty D1 is set on the assumption that the input voltage has a maximum amount, and the resistance value has a minimum amount. A maximum current application duty $D_{limit}$ that is an applicable upper limit is calculated from a detected current value I1, the fixed duty D1, and a predetermined applicable current value $I_{limit}$ in the engine controller 11 (S24). If the current value detected by the electric-current detection circuit 27 is an effective value, the duty $D_{Limit}$ is calculated according to the following equation.

$$D_{limit}=(I_{limit}/I1)^2\times D1$$

The current value $I_{limit}$ sets an allowable current value obtained by subtracting an electric current supplied to elements excluding the ceramic heater 24 with respect to a rated current of the AC power source 1 to be connected.

The duty $D_{Limit}$ at the start of the heater is calculated, and then a regular temperature adjustment is started (S25). The engine controller 11 detects whether or not all fixing devices are being lit (S26), and, if all fixing devices are being lit, the same control as in the first embodiment mentioned above is performed. In detail, the engine controller 11 detects whether or not an electric current is applied in a state in which the phase angle of electric power supplied to the fixing device is above the fixed duty D1 (i.e., below the phase angle $\alpha 1$). If above the fixed duty D1, a current value I2 is always detected by a phase angle $\beta$ supplied to the fixing device and the HCRRT signal sent from the electric-current detection circuit 27 (S28). The engine controller 11 determines a maximum current application duty $D_{limit}$ that is an applicable upper limit from the detected current value I2, the phase angle $\beta$, and the predetermined applicable current value $I_{limit}$ (S29).

Figures 10A, 10B, 10C, 10D, 10E:
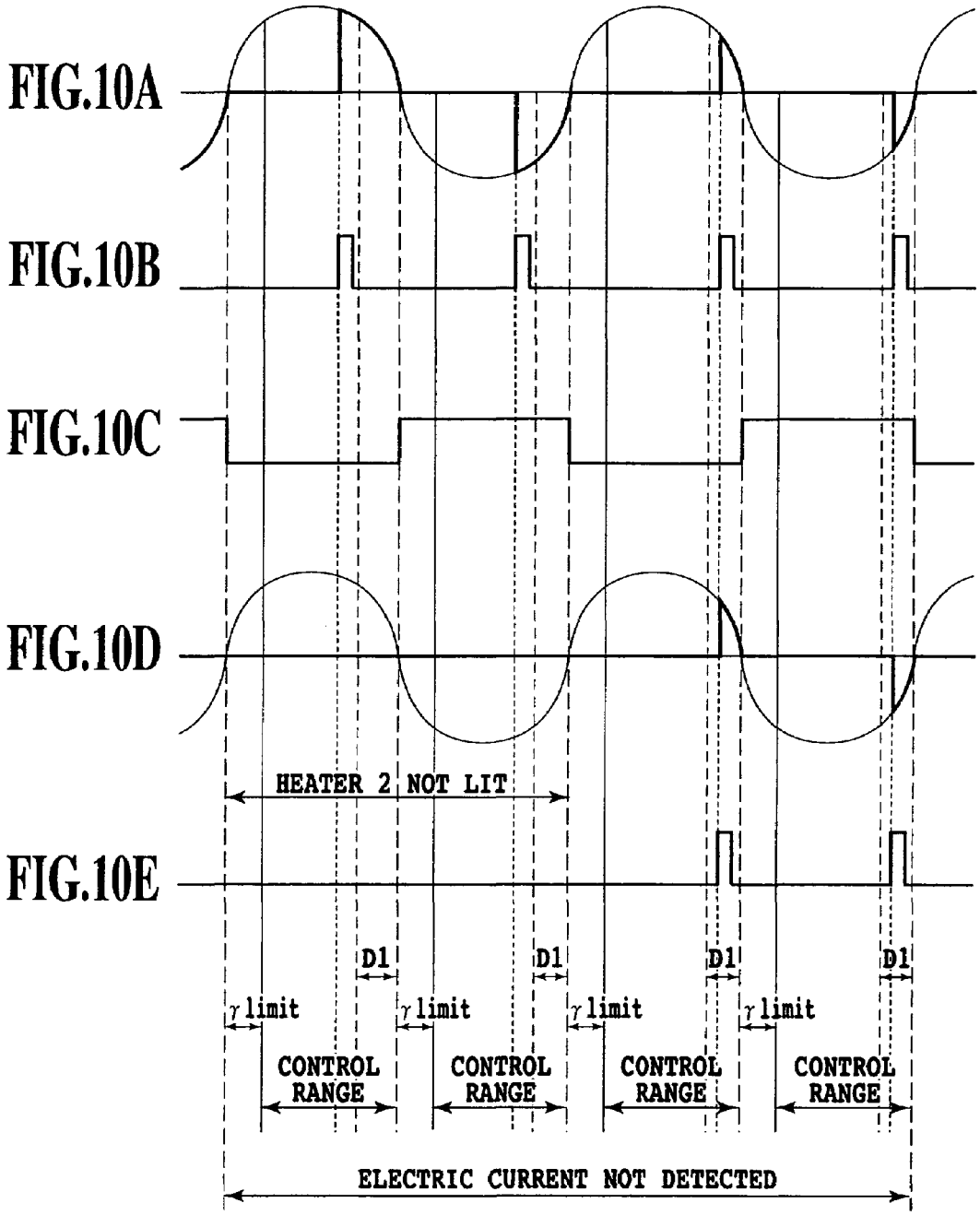
FIGS. 10A-10E are charts showing operation waveforms of the control sequence according to the second embodiment.

In the second embodiment, an electric current is applied to both heaters, and the current value I2 is detected only when an electric current is applied to both heaters above the fixed duty D1 (i.e., below the phase angle $\alpha 1$). FIGS. 10A-10E show an example in which the current value I2 is not detected. FIG. 10A is a waveform of a heater current supplied to the heating element 3, and FIG. 10B is a waveform of the ON1 signal. FIG. 10D is a waveform of a heater current supplied to the heating element 20, and FIG. 10E is a waveform of the ON2 signal. An electric current is not applied to the heating element 20 when control is started (i.e., during one period at the left in the figure).

If all fixing devices are not being lit or if an electric current is not applied in a state in which the phase angle of electric power supplied to the fixing device is above the fixed duty D1, the upper limit power duty holds the last determined duty $D_{limit}$ (which corresponds to a phase angle $\gamma_{limit}$ and which is represented as $D_{limit}(\gamma)$ herein) without detecting the current value I2.

If the calculated maximum current application duty $D_{limit}(\gamma)$ that is an applicable upper limit exceeds the last determined duty $D_{limit}$, electric power is supplied, with the upper limit value as $D_{limit}(\gamma)$. That is, a PI temperature adjustment is performed in a state of being below the applicable upper limit maximum current application duty $D_{limit}(\gamma)$ (i.e., above the phase angle $\gamma_{limit}$) (S30). One period at the right in FIGS. 10A-10E corresponds thereto. Although the duty $D_{limit}$ is always changing as mentioned above, control can be always carried out below the current $I_{limit}$. Control is carried out below the calculated maximum current application duty $D_{limit}(\gamma)$ until receiving a command to end the heater temperature adjustment (S31).

As described above, in the second embodiment, the detection is always performed for whether or not all fixing devices are being lit during the regular temperature adjustment and whether or not an electric current is applied in a state of being above the fixed duty D1 that is set not to exceed an allowable current value. If all fixing devices are being lit and if an electric current is applied in a state of being above the fixed duty D1, the upper limit value of supplied power is calculated, and the electric power is controlled below the calculated upper limit value. Accordingly, an electric current exceeding the allowable current value can be prevented from being supplied.

Additionally, if an upper limit power duty is determined based on a current value that has been detected in a state in which some of the heating elements are not supplied with an electric current while paper is being fed, the upper limit power duty is set to be higher, and an excessive current can be prevented from being supplied.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An image forming apparatus comprising:

an image forming section for forming a toner image on a recording paper;

a fixing device for fixing the toner image formed on the recording paper, said fixing device including a cylindrical fixing film, a ceramic heater having heating elements and contacting with an inside surface of said cylindrical fixing film, and a pressure roller forming a fixing nip portion in conjunction with said ceramic heater via said cylindrical fixing film;

a temperature detector for detecting a temperature of the ceramic heater;

an electric power supply controller for controlling a power duty supplied to the heating elements from a power source so that the temperature detected by the temperature detector is maintained at a target temperature:

an electric-current detection circuit for detecting a heater current value supplied to the heating elements; and wherein the electric power supply controller calculates a maximum power duty ($D_{limit}$) supplied to the heating elements by an equation 1 as below and sets the power duty supplied to the heating elements so as to maintain at the target temperature so that said power duty does not exceed the maximum power duty ($D_{limit}$), the equation 1 being:

$$D_{limit}=(I_{limit}/I1)^2*D1$$

where D1 is a predetermined fixed power duty when starting to supply electric power to the heating elements, I1 is the heater current value detected by the electric-current detection circuit while supplying electric power to the heating elements with the predetermined fixed power duty (D1), and $I_{limit}$ is a predetermined applicable current value after subtracting a current value supplied to the heating elements in the image forming apparatus excluding the ceramic heater from a rated current value of the power source;

wherein, (1) when a power duty (Dβ) supplied to the heating elements so as to maintain the ceramic heater at the target temperature equals to or exceeds the predetermined fixed power duty (D1), the electric power supply controller changes the predetermined fixed power duty (D1) of equation 1 the power duty (Dβ), changes the heater current value (I1) to a heater current value (I2) detected by the electric-current detection circuit while supplying electric power to the heating elements with the power duty (Dβ), and calculates and resets new maximum power duty ($D_{limit}\beta$) based on equation 1, and wherein (2) when a power duty (Dβ) supplied to the heating elements so as to maintain at the target temperature does not exceed the predetermined fixed power duty (D1), the electric power supply controller does not calculate and reset a new maximum power duty ($D_{limit}\beta$).

* * * * *